United States Patent [19]

Nelson et al.

[11] 4,436,502

[45] Mar. 13, 1984

[54] AUGER FEED ARRANGEMENT FOR CUBING MACHINE

[75] Inventors: Garth C. Nelson, El Cajon; Henry J. White, La Jolla; Gerald B. Nelson, San Diego, all of Calif.

[73] Assignee: Papakube Corporation, San Diego, Calif.

[21] Appl. No.: 428,857

[22] Filed: Sep. 30, 1982

[51] Int. Cl.[3] ..... B30B 9/28; B30B 11/24

[52] U.S. Cl. ..... 425/331; 100/145; 100/147; 100/904; 198/659; 425/376 R; 425/DIG. 230

[58] Field of Search ..... 425/DIG. 230, 331, 376 R, 425/376 B; 198/659; 366/318, 319; 100/145, 147, 904

[56] References Cited

U.S. PATENT DOCUMENTS

| | | | |
|---|---|---|---|
| 3,279,396 | 10/1966 | Soteropulos | 425/DIG. 230 |
| 3,354,844 | 11/1967 | Roll et al. | 425/DIG. 230 |
| 3,363,587 | 1/1968 | Harrington et al. | 425/DIG. 230 |
| 3,363,588 | 1/1968 | Harrington et al. | 425/DIG. 230 |
| 4,203,237 | 5/1980 | Enters et al. | 198/659 |

OTHER PUBLICATIONS

Eide et al., Auger System, IBM Tech. Disclosure Bul., vol. 23 #9, Feb. 1981, p. 4036.

*Primary Examiner*—Willard E. Hoag

*Attorney, Agent, or Firm*—Francis B. Francois; Francis D. Thomas, Jr.

[57] ABSTRACT

A cylindrical housing and auger drum assembly is mounted to extend from the side of a cubing machine of the type having an annular die assembly, a circular die cavity on the inner periphery of the die assembly, and at least one press wheel that is received in the die cavity. The auger drum carries a rigid blade that forms an auger flight, and which terminates a short distance from the outer end of the drum. A flexible, resilient tip is mounted on the outer end of the rigid blade, and substantially fills the space provided between the auger drum, the housing and the die cavity, the outer edge of the tip being positioned at the die cavity. The tip functions to supply an optimum flow of feed stock to the die cavity, but will flex to allow bypassing when plugging or jamming conditions exist.

9 Claims, 3 Drawing Figures

AUGER FEED ARRANGEMENT FOR CUBING MACHINE

TECHNICAL FIELD OF THE INVENTION

The present invention relates generally to auger feed arrangements for supplying feed stock to the circular die cavity of a cubing machine, and more particularly to an improved outer tip arrangement for the blade of a drum auger flight that is designed to increase the supply of feed stock to the circular die cavity and improve the efficiency of the cubing machine.

BACKGROUND OF THE INVENTION

There have been a number of machines developed which are designed to accept fibrous feed stock, and to act thereupon to compress it and produces highly compacted pellets or cubes. Commonly called cubing machines, machines of the general type to which this invention relates are shown in U.S. Pat. Nos. 3,279,396; 3,354,844; 3,363,587; and 3,407,756. Cubing machines of this general type have an annular die assembly that is clamped between mounting plates, and which has a plurality of equally spaced die openings extending radially therethrough. A circular die cavity or track is formed on the inner periphery of the annular die assembly, and a circular press wheel having a diameter substantially smaller than the inner diameter of the annular die assembly is mounted eccentrically on a rotating bracket and rides in the track; sometimes, a plurality of such press wheels are utilized, usually spaced evenly about the central axis of the annular die assembly. A drum auger is arranged to extend concentrically about the central axis of the annular die assembly from one side of the assembly, thereof, and is mounted within a housing that may carry one or more mating auger flights on its interior. The drum auger functions to accept feed stock from an intake hopper or the like, and to deposit it into the circular die cavity or track ahead of the rotating press wheel. The press wheel compresses the feed stock into the circular die cavity or track, and forces it under pressure through the die openings to produce an extrusion that is then broken into pieces to form pellets or cubes.

The auger flight carried on the drum auger is typically constructed of a helically or spirally-arranged metallic blade that is welded on the outer surface of a cylindrical drum, to produce the flight. The forward tip of this auger blade, that is, the end thereof adjacent to the circular die cavity or track, is perhaps the most critical element of the auger because its function is to directly deposit the feed stock into the cavity. Usually, the auger blade tip will be tapered downwardly to a minimum height at its outer end, and sometimes it will be provided with a replaceable metallic wear plate required because extensive tip wear is common in a cubing machine. The typical rigid metallic tip of an auger blade is spaced a substantial distance from the press wheel and the die assembly, and is shaped to provide considerable clearance so that jamming of the feed stock and consequent possible damage to the machine will be avoided by providing a relatively large space through which feed stock can flow if an excessive accumulation occurs.

While providing space between the auger tip, the annular die assembly and the press wheel will usually solve the jamming or plugging problem, it also normally allows a considerable amount of feed stock to unnecessarily escape from in front of the press wheel as the latter is rotated around the circular die cavity or track. This in turn reduces the efficiency of the cubing machine over what might otherwise be possible, and functions to allow feed stock to escape even when the stock is sufficiently dry and of a characteristic that jamming or plugging of the equipment is not likely to occur.

There is thus need for an improved feed auger tip arrangement for a cubing machine, one that will increase the supply of feed stock deposited in the circular die cavity in front of the press wheel of the machine under normal circumstances, but which will still allow feed stock to escape from the die cavity or track when necessary so that jamming or plugging of the equipment will not occur. The present invention is intended to satisfy that need.

SUMMARY OF THE INVENTION

In the present invention the usual drum auger of a conventional cubing machine is modified by placing a replaceable, flexible tip on the outer end of the metallic blade of the auger flight welded to the drum. The flexible tip is not cut or tapered back as is now done in cubing machines to allow for the escape of feed stock from in front of the press wheel. Rather the tip of the invention is specifically designed to nearly fill the feed space leading from the auger flight into the circular die cavity or track in front of the press wheel, and the flexible characteristic of the tip is relied upon to allow feed stock to escape or be bypassed when this action becomes necessary.

With the enlarged, flexible auger tip of the invention, the maximum amount of feed stock is supplied in front of the cubing machine's press wheel. Under normal conditions the machine is capable of processing such a maximum supply of feed stock, and thus the invention will significantly increase the output and efficiency of the cubing machine. Should the feed stock be of a characteristic such that it is unduly resistive to being pressed and extruded through the die openings so that jamming or plugging might otherwise occur, the flexible tip will then move out of the way to the extent required to allow an adequate amount of feed stock to escape so that jamming or plugging will be avoided. When the possible jamming or plugging condition is over, the flexible tip will then move back into position. In other words, in the invention the flexible auger tip in effect reacts to operational conditions, and controls the amount of feed stock being supplied to the annular die assembly so that the operating efficiency of the cubing machine is maintained at or close to maximum.

The flexible auger tip of the invention is mounted on a backing plate carried by the metallic auger blade, and is secured thereto by a clamping plate and suitable fasteners. With this arrangement, the flexible tip can be easily replaced when required. The flexible tip can be made from a number of materials, but in the preferred embodiment of the invention is constructed of multiple layers of a suitable heat resistant rubber, provided with an outer coating of tetrafluoroethylene or a similar lubricating substance to facilitate the flow of feed stock thereover.

It is the principal object of the present invention to provide an improved auger feed arrangement for a cubing machine, designed and arranged to assure an optimum supply of feed stock to the annular die assembly of such a machine while at the same time guarding against jamming or plugging of the machine if the feed stock supply should temporarily prove excessive.

A further object is to provide an improved tip arrangement for a feed auger, designed to assure an optimum supply of feed stock to a machine when the machine will accept it, but to automatically accommodate to conditions and allow an escape or bypassing of some of the feed stock should this be necessary to prevent plugging or jamming of the machine.

Another object is to provide a flexible tip for the feed auger of a cubing machine, designed and arranged so that it can be easily replaced when damaged or worn.

Other objects and many of the attendant advantages of the present invention will become readily apparent from the following Detailed Description of the Preferred Embodiment, when taken in conjunction with the accompanying drawings.

DESCRIPTION OF THE PREFERRED EMBODIMENT

Figure 1:
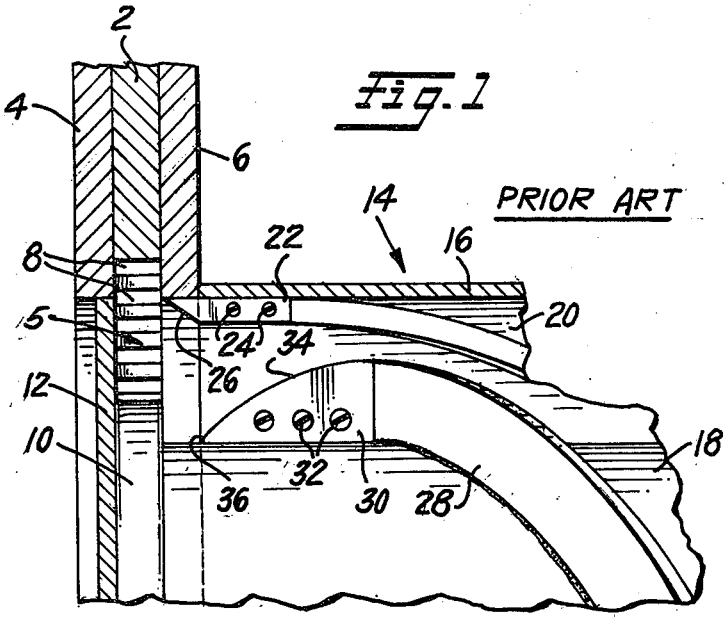
FIG. 1 is a fragmentary elevational view, partly in section, showing the relationship between the annular die assembly, the press wheel and the feed auger of a typical cubing machine of the prior art.

Referring now to FIG. 1 the drawings, a typical cubing machine, annular die assembly of the prior art is indicated generally at 2, the assembly being clamped between mounting plates 4 and 6 and having a plurality of spaced radial die openings 8 on the inner annular face thereof through which feed stock is pressed. The mounting plates 4 and 6 define a circular die cavity or track 5 that extends around the inner periphery of the die assembly 2, and which will accommodate the outer rim portion of an eccentrically mounted press wheel 10 that is arranged to be rotated around the track in confrontation to the inner annular face of the annular die assembly.

A backing plate 12 is mounted on one side of the press wheel 10, and a feed auger assembly 14 extends from the other side of the press wheel and is mounted concentrically about the central axis of the annular die assembly 2. The elements thus far described are common in the type of cubing machine to which this invention relates, and a further description of these elements and related components and how they function will be found in the patents cited hereinabove. Note, for example, the annular die assembly 74 and press wheels 104 and 106 in U.S. Pat. No. 3,279,396, the annular die assembly 38 and press wheel 82 in U.S. Pat. No. 3,363,587, and the auger feed assemblies in both patents.

The feed auger assembly 14 of FIG. 1 is also known to the prior art, and includes an outer, cylindrical housing 16 within which a cylindrical auger drum 18 is concentrically mounted for rotation about the central axis of the annular die assembly 2. The outer housing 16 carries a blade 20 on its inner surface that defines a fixed auger flight, which terminates in a replaceable, rigid tip 22 that is secured in place by screws 24 and which extends to the edge of the circular die cavity or track 5. The tip 22 is cut-back or tapered along one edge 26, so that it terminates in a point-like end.

Mounted on the cylindrical drum 18 is a rigid blade 28 of metal or the like, which is welded to the drum and wound thereabout in a spiral manner to form an auger flight. The front end of the auger blade 28 carries a rigid tip 30 of metal or the like that is secured thereby by screws 32, and which tapers rather uniformly on its top edge 34 from a maximum where it connects with the body of the blade 28 to a minimum height at its outer edge 36. The outer edge 36 of the rigid blade tip 30 stops some distance from the circular die cavity or track 5 in which the press wheel 10 is seated, with the overall result that substantial clearance exists between the tip 30, the press wheel 10 and the outer housing 16.

In use, the cylindrical drum 18 is rotated and the auger blade 28 is effective to carry feed stock from a supply hopper (not shown) mounted at the outward end of the feed auger assembly 14 to the circular die cavity or track 5 and to deposit the material into the cavity in front of the press wheel 10. However, because of the tapered edge 34 on the rigid tip 30 and the clearance provided between the tip and nearby walls, a considerable amount of feed stock simply escapes over the tip 30 and does not enter the die cavity or track 5. This escape of feed stock, while it may avoid possible jamming or plugging of the die assembly under certain conditions, results in a considerably lower operating efficiency for the cubing machine than what is possible.

Figure 2:
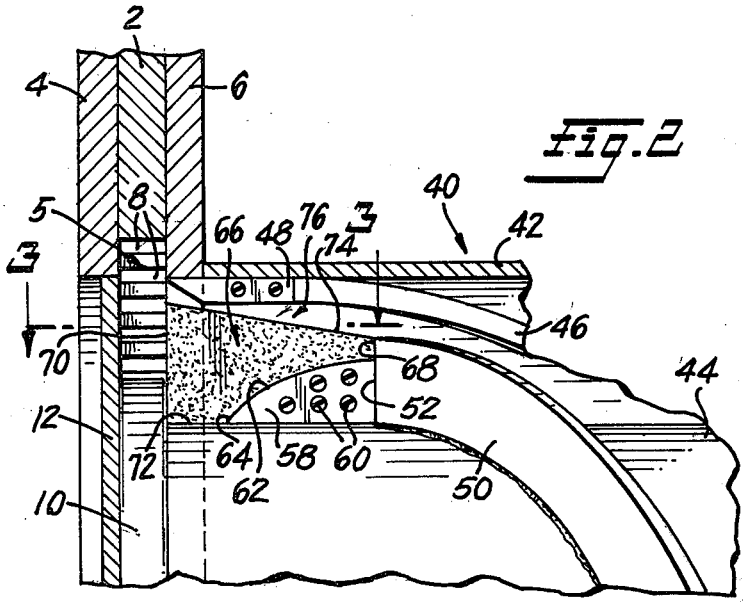
FIG. 2 is a fragmentary elevational view similar to FIG. 1, but wherein the blade mounted on the auger drum is provided with the flexible tip of the invention.
Figure 3:
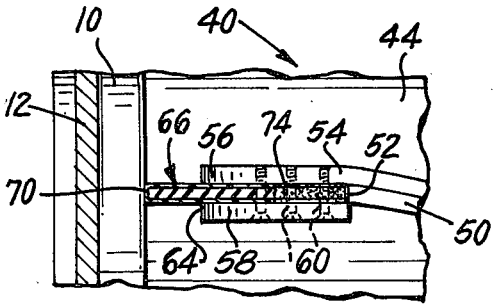
FIG. 3 is a view taken generally on the line 3—3 of FIG. 2, and shows the arrangement of the flexible auger tip of the invention in plan view.

Referring now to FIGS. 2 and 3, the improved feed auger arrangement of the invention is shown. In said figures, the annular die assembly 2, the mounting plates 4 and 6, the circular die cavity or track 5, the press wheel 10 and the backing plate 12 are identical to those shown in FIG. 1, and thus carry the same reference numbers. A feed auger assembly 40 is connected to supply feed stock to the die assembly 2 in FIG. 2, and includes an outer, cylindrical housing 42 within which a rotatable auger drum 44 is concentrically mounted. The housing 42 has a fixed blade 46 of metal or the like welded thereto that forms an auger flight, and which terminates in a rigid replaceable tip 48 corresponding to the replaceable tip 22 of FIG. 1.

The auger drum 44 has a rigid blade 50 of metal or the like welded thereto, the blade 50 being wound around the drum 44 in a spiral-like manner to form an auger flight. The forward end of the blade 50 terminates at a point spaced inwardly from the outer end of the auger drum 44 to form a radial end face 52, and the rear surface of the blade 50 has a backing plate 54 welded or otherwise secured thereto that includes a projecting nose portion 56 adapted to receive a clamping plate 58. The clamping plate 58 is detachably secured to the nose portion 56 of the backing plate 54 by a plurality of screw fasteners 60 or the like, and the areas and profiles of the nose portion 56 and the clamping plate 58 are essentially identical. Looking at FIG. 2, it will be noted that the upper edge 62 of the clamping plate 58 has a maximum height that is less than that of the radial end face 52, and that it extends outwardly and downwardly from the end face 52 in a rounded taper to a minimum height outer tip 64 that is spaced inwardly a substantial distance from the outer end of the auger drum 44.

Clamped between the backing plate nose portion 56 and the clamping plate 58 is the flexible auger tip 66 of the invention, which is made from multiple layers of a suitable rubber or some other acceptable material having the required characteristics of resilience and sufficient toughness to be wear resistant. Preferably, the flexibile auger tip 66 is coated with a protective, lubricating material such as tetrafluoroethylene. The auger tip 66 has the general configuration of a trapezoid, and includes parallel inner and outer edges 68 and 70, and a bottom edge 72. The outer tip edge 70 extends to the very edge of the die cavity or track 5, and when initially installed will preferably extend slightly into the cavity so that it will be engaged by the press wheel 10 as it rotates. The upper edge 74 of the flexible tip 66 extends upwardly at an angle from the top of the inner edge 68, the inner edge 68 having a height substantially equal to the height of the radial blade end face 52. A clearance space 76 is provided between the edge 74 and the outer upper flight 46 and its tip 48, but this space is only a small fraction of the similar clearance provided in FIG. 1 between the auger tip 30 and nearby surfaces.

In use, the flexible tip 66 functions to supply feed stock to the circular die cavity or track 5 from the rotating auger core 44, and deposits the feed stock directly into the cavity in front of the press wheel 10. Because essentially no clearance is provided between the outer tip edge 70 and the press wheel 10, under normal operating conditions most or substantially all of the supplied feed stock enters the die cavity unlike in FIG. 1 wherein a substantial quantity of the feed stock can simply be bypassed or allowed to escape over the smaller, rigid tapered tip 30.

In those instances where the supply of feed stock to the annular die cavity or track 5 in FIG. 2 becomes excessive, as for example when the feed stock is overly damp and cannot move easily through the die openings 8, the possibility of the cubing machine being jammed or plugged is alleviated in the present invention because the outer portions of the tip 66 will then flex out of the way to allow bypassing of some of the feed stock. It will be noted that the flexible tip 66 is anchored firmly, but only over about one-third of its area at the tip's lower, inner corner. This leaves about the outer one-third of the lower tip edge 72 and the upper, outer portion of the flexible tip 66 free to flex, so that bypassing can occur. The rounded, tapered upper edges of the clamping plate 58 and its correspondingly shaped mounting plate nose portion 56 facilitate flexing of the tip 66, and prevent damage from occurring thereto. When the conditions requiring bypassing of feed stock are relieved, the resilient flexible tip 66 will return to its original position, with the outer edge 70 thereof positioned as in FIG. 2. The clearance 76 is maintained to provide for a small amount of bypassage of material during normal operation of the auger feed, and to provide an initial area for significant bypass flow to commence when plugging or jamming of the cubing machine might occur, so that flexing of the tip 66 will more easily begin.

It will be readily appreciated that the flexible tip 66 of the invention functions to in effect regulate the flow of feed stock to the die cavity or track 5, the tip automatically adjusting itself through its flexible, resilient characteristics so that an optimum supply of feed stock can be maintained to the die assembly 2. This will in turn help assure optimum operating efficiency for the cubing machine. By utilizing a flexible tip 66 that is initially somewhat oversize, it will quickly wear into an optimum shape during usage. This allows the flexible tip 66 to in effect be custom fitted to the characteristics of the cubing machine in which it is utilized. When a flexible tip 66 becomes overly worn, it is easily replaced. Further, unlike with the rigid tip 30 of FIG. 1, if small pieces of the flexible tip 66 should break off during usage as wear progresses, the rubber or similar material thereof will usually allow such pieces to be processed through the die assembly 2 without causing equipment damage.

The feed stock supplied to a cubing machine can be of several different kinds, including hay and grass cuttings, plant stalks, and various other fibrous substances. The material used for feed stock is usually chopped or otherwise reduced into fragments before being supplied to the auger assembly, and the flexible tip 66 of the invention is intended to be used with essentially any feed stock that is suitable for the die assembly 2.

An important feature of the invention is that the flexible tip 66 more uniformly distributes feedstock into the circular die cavity 5 than has heretofore been possible because of its ability to uniformally regulate feedstock flow. This in turn increases the productive efficiency of the cubing machine since now essentially all of the radial die openings 8 will be provided optimum amount of feedstock that is relatively uniform over the circumference of the annular die assembly 2. Obviously modifications and variations of the invention as shown and described are possible.

We claim:

1. In a cubing machine having an annular die assembly, a circular die cavity formed about the inner periphery of said die assembly, and at least one press wheel adapted to be seated in said circular die cavity and arranged to be rotated therearound, an auger arrangement for supplying feed stock to said circular die cavity, including:

an outer housing;

an auger drum mounted concentrically within said housing and spaced therefrom, said housing and auger drum being arranged generally on the central axis of said annular die assembly to extend from one side of said circular die cavity, and said auger drum being rotatable relative to said housing and having the outer end thereof disposed in closely spaced relationship to said annular die cavity;

a rigid blade mounted on said auger drum and forming an auger flight, the outer end of said blade terminating short of the outer end of said auger drum;

a mounting plate carried on the outer end of said rigid blade and extending outwardly therefrom, the outer end of said mounting plate also terminating short of the outer end of said auger drum;

a clamping plate adapted to be mated with said mounting plate;

means for connecting said clamping plate with said mounting plate; and a flexible, resilient tip arranged to be clamped at its lower, inner corner between said mounting plate and said clamping plate, said flexible, resilient tip extending at least to the outer end of said auger drum and having a height that is generally at least equal to the height of said rigid blade.

2. In a cubing machine as recited in claim 1, wherein said housing is cylindrical, and has a rigid blade mounted on the interior thereof to form an auger flight that confronts the auger flight on said auger drum.

3. In a cubing machine as recited in claim 1, wherein about one-third the area of the said flexible, resilient tip is secured between said clamping plate and said mounting plate.

4. In a cubing machine as recited in claim 2, wherein the upper edges of said clamping plate and said mounting plate are rounded to facilitate flexing of said tip and to prevent damage thereto when flexing occurs.

5. In a cubing machine as recited in claim 1, wherein said flexible, resilient tip is made from multiple layers of rubber.

6. In a cubing machine as recited in claim 5, wherein said tip is coated with a lubricating protective material.

7. In a cubing machine as recited in claim 1, wherein said flexible, resilient tip is generally trapezoidal in shape, and includes an inner edge having a height at least as great as the height of said blade, an outer edge that extends generally parallel to said inner edge, a bottom edge extending parallel to said auger drum and lying in closely spaced relationship thereto, and a top edge, said top edge being spaced from said housing to provide a small clearance therebetween.

8. In a cubing machine as recited in claim 7, wherein said outer edge is tapered upwardly and outwardly from the top of said inner edge.

9. In a cubing machine as recited in claim 7, wherein said outer edge of said flexible, resilient tip extends to the edge of said annular die cavity, and is arranged so that at least when said tip is initially installed and before wear occurs said press wheel will engage said outer edge.

* * * * *